US007708087B2

(12) United States Patent
Stables et al.

(10) Patent No.: US 7,708,087 B2
(45) Date of Patent: May 4, 2010

(54) COUNTERSINK ROOF BIT DRILL AND METHOD FOR USING THE SAME

(75) Inventors: Brandon S. Stables, Bedford, PA (US); Douglas E. Bise, Chillhowie, VA (US); John G. Oldsen, Butler, PA (US); Donald E. Keller, Bedford, PA (US); David Scott Rife, Greensburg, PA (US); John C. Stankus, Canonsburg, PA (US); Chad A. Swope, Bedford, PA (US)

(73) Assignees: Kennametal, Inc., Latrobe, PA (US); Jennmar Corporation, Pittsburgh, PA (US)

( * ) Notice: Subject to any disclaimer, the term of this patent is extended or adjusted under 35 U.S.C. 154(b) by 366 days.

(21) Appl. No.: 11/733,372

(22) Filed: Apr. 10, 2007

(65) Prior Publication Data

US 2008/0251296 A1 Oct. 16, 2008

(51) Int. Cl.
*E21B 10/62* (2006.01)

(52) U.S. Cl. ..... 175/40; 175/385; 299/111

(58) Field of Classification Search ..... 175/327, 175/385, 403, 421, 425, 426, 40; 299/110, 299/111; 405/259.1
See application file for complete search history.

(56) References Cited

U.S. PATENT DOCUMENTS

| | | | | |
|---|---|---|---|---|
| 654,861 | A | 7/1900 | Tyman | |
| 2,700,905 | A * | 2/1955 | Urquhart | 408/113 |
| 2,708,105 | A * | 5/1955 | Williams, Jr. | 175/400 |
| 3,090,203 | A | 5/1963 | Durget | |
| 4,079,766 | A | 3/1978 | Conley et al. | |
| 4,448,269 | A * | 5/1984 | Ishikawa et al. | 175/335 |
| 4,523,881 | A | 6/1985 | Ringe | |
| 4,708,559 | A | 11/1987 | Locotos | |
| 5,064,311 | A | 11/1991 | Giroux et al. | |
| 5,259,703 | A | 11/1993 | Gillespie | |
| 5,511,909 | A | 4/1996 | Calandra, Jr. et al. | |
| 5,586,839 | A | 12/1996 | Gillespie | |
| 5,628,587 | A | 5/1997 | Lesslie | |
| 5,769,570 | A | 6/1998 | Stankus et al. | |
| 5,791,823 | A | 8/1998 | Blakley et al. | |
| 5,791,824 | A | 8/1998 | Radtke | |
| 5,791,828 | A | 8/1998 | Fergusson | |
| 5,934,855 | A | 8/1999 | Osterle et al. | |
| 5,954,456 | A | 9/1999 | Bowles | |
| 6,056,482 | A | 5/2000 | Calandra, Jr. et al. | |
| 6,428,243 | B1 | 8/2002 | Hutchins | |
| 6,457,909 | B1 | 10/2002 | Xu et al. | |
| 6,648,557 | B1 | 11/2003 | Morrow et al. | |
| 6,682,268 | B2 | 1/2004 | Robertson, Jr. et al. | |
| 6,881,015 | B2 | 4/2005 | Wallstein et al. | |
| 7,100,714 | B1 * | 9/2006 | Sollami | 175/427 |
| 2003/0143038 | A1 | 7/2003 | Babcock | |
| 2004/0161316 | A1 | 8/2004 | Locotos et al. | |
| 2006/0278436 | A1 * | 12/2006 | Dykstra et al. | 175/57 |

* cited by examiner

*Primary Examiner*—William P Neuder
(74) *Attorney, Agent, or Firm*—The Webb Law Firm

(57) ABSTRACT

A roof bit drill has a central shaft with a front end and a back end. The drill also has a base secured about the central shaft proximate to the front end, wherein the base has clearance channels extending axially therethrough. At least one cutting element is arranged on the base in a convex cutting pattern to permit loosened material to be evacuated. The roof bit drill may further include a drill depth locator to identify when the drill has been advanced within a mine roof to a predetermined depth. A method for using the roof drill bit is also disclosed herein.

46 Claims, 15 Drawing Sheets

FIG. 7B
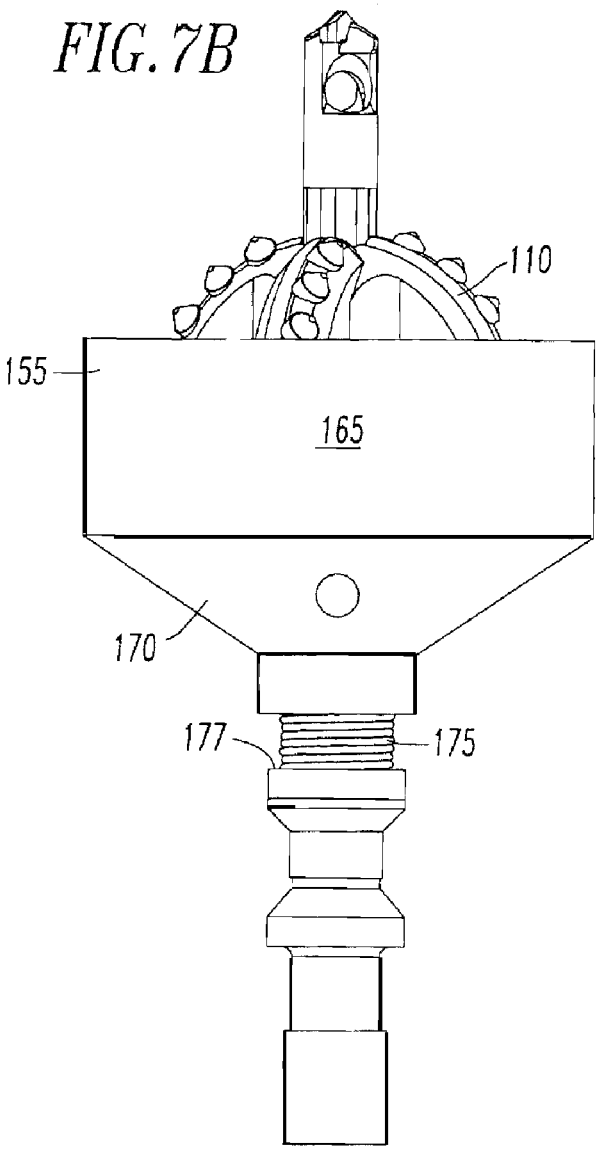
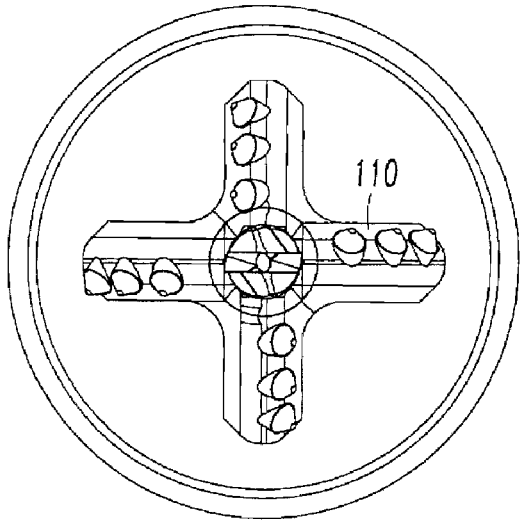
FIG. 7C

COUNTERSINK ROOF BIT DRILL AND METHOD FOR USING THE SAME

BACKGROUND OF THE INVENTION

1. Field of the Invention

The present invention relates to a roof bit drill and, more particularly, to a roof bit drill used for imparting within the roof of a mine, counter bores suitable for recessing roof mine bolts.

2. Description of Related Art

In mine work, such as coal mining, or in underground formations such as tunnels or other excavations, it is necessary to reinforce or support the roof and/or walls of the excavation to prevent rock falls or cave-ins. Among the most common means in use for such support are cable bolts or other suitable elongated members, such as rod bolts, which are inserted into bore holes and exposed to a resin mixture or anchored therein to hold a metal support or bearing plate in tight engagement with a roof or wall surface. With respect to cable bolts, a resin system introduces resin capsules or cartridges into the bore hole and then advances the cables to a blind end of the bore hole by the cable bolt backing the capsules. The spinning of the cable bolt ruptures the capsules and mixes the resin system supplied.

Each of these cable bolts or rod bolts utilize either a barrel or wedge assembly or a bolt head, respectively, to secure the metal support or bearing plate against the roof. Therefore, the barrels of the cable bolts extend into the usable walk/crawl or transportation space in a mine as defined by the distance from the floor to the ceiling of the mine tunnel. FIG. 1 depicts a prior art cable bolt including a wedge assembly 2 and a multi-strand cable 3 secured to a barrel 8 as situated with respect to a roof line in a mine. A drive head, such as a nut 9, may be attached to a free end of the cable 3. An exemplary height of the prior art barrel and wedge assembly 2 is approximately 3 inches. Accordingly, several inches (not including the thickness of the prior art bearing plate 6) of material extends below the roof line. The prior art barrel and wedge assembly 2 used in connection with typical low clearance tunnels requires that due care be exercised while moving within the tunnel, as the extending bolt head may be engaged by moving equipment or mine personnel.

FIG. 2 illustrates another prior art embodiment, wherein a countersunk recess 13, which may have a generally curved profile, such as substantially semi-spiracle, is formed through a roofline 10 into the roof 11 to accommodate a crater plate or dome plate 14 therein. The crater plate 14 includes a raised portion 16 that substantially corresponds to the shape of the countersink 13. As a result of the profile of the crater plate 14, a cable 21 or bolt may be positioned within a top portion 30*a* of the barrel 26 such that the cable bolt/cable rod is significantly recessed within the roof line thereby reducing the obstruction caused by this assembly. The barrel 26 of the bolt cable 21 illustrated in FIG. 2 has a bottom portion 32 which protrudes below the roof line.

However, drilling such a hole may be challenging because there are no drills known to the inventors capable of producing such a countersink and, furthermore, any drill that is capable of producing such a countersink would, in all likelihood, require accessories to collect material removed by the drill and minimize the production of dust.

FIG. 3 illustrates a drill bit tool 70 which includes a counter bore bit 72 securely fixed to a first drill shaft 74. The counter bore bit 72 is sized to create the countersink 13 (FIG. 2) to accommodate a crater plate having a corresponding shape. The counter bore bit 72 may include raised cutting surfaces or protrusions, such as ribs 73. However, this design makes no provisions for evacuating either dust produced by this operation or larger material removed during this operation.

BRIEF SUMMARY OF THE INVENTION

One embodiment of the invention is directed to a roof drill bit comprised of a central shaft with a front end and a back end, a base secured about the central shaft proximate to the front end, wherein the base has clearance channels extending radially therethrough; and at least one cutting element arranged on the base in a convex cutting pattern.

Another embodiment of the subject invention is directed to a roof bit drill comprised of a central shaft with a front end and a back end, a base secured about the central shaft proximate to the front end, wherein the base has clearance channels extending radially therethrough; at least one cutting element arranged on the base; and a drill depth locator to identify when the drill has been advanced within a mine roof to a predetermined depth.

Yet another embodiment of the subject invention is directed to a method of identifying a predetermined depth for the advancement of a roof bit bolt comprising the step of advancing the roof bit bolt within the roof of a mine until a depth indicator signals the proper depth has been reached.

BRIEF DESCRIPTION OF THE DRAWINGS

FIG. 7B is a side view of the roof bit drill illustrated in FIG. 7A with the boot retracted;

FIG. 7C is a top view of the roof bit drill illustrated in FIGS. 7A and 7B;

DETAILED DESCRIPTION OF THE INVENTION

Throughout this discussion, the term roof will be utilized. However, it should be understood that the subject invention may also be utilized with mine walls, and the use of the term roof should be understood to apply to walls as well.

Figure 4A:
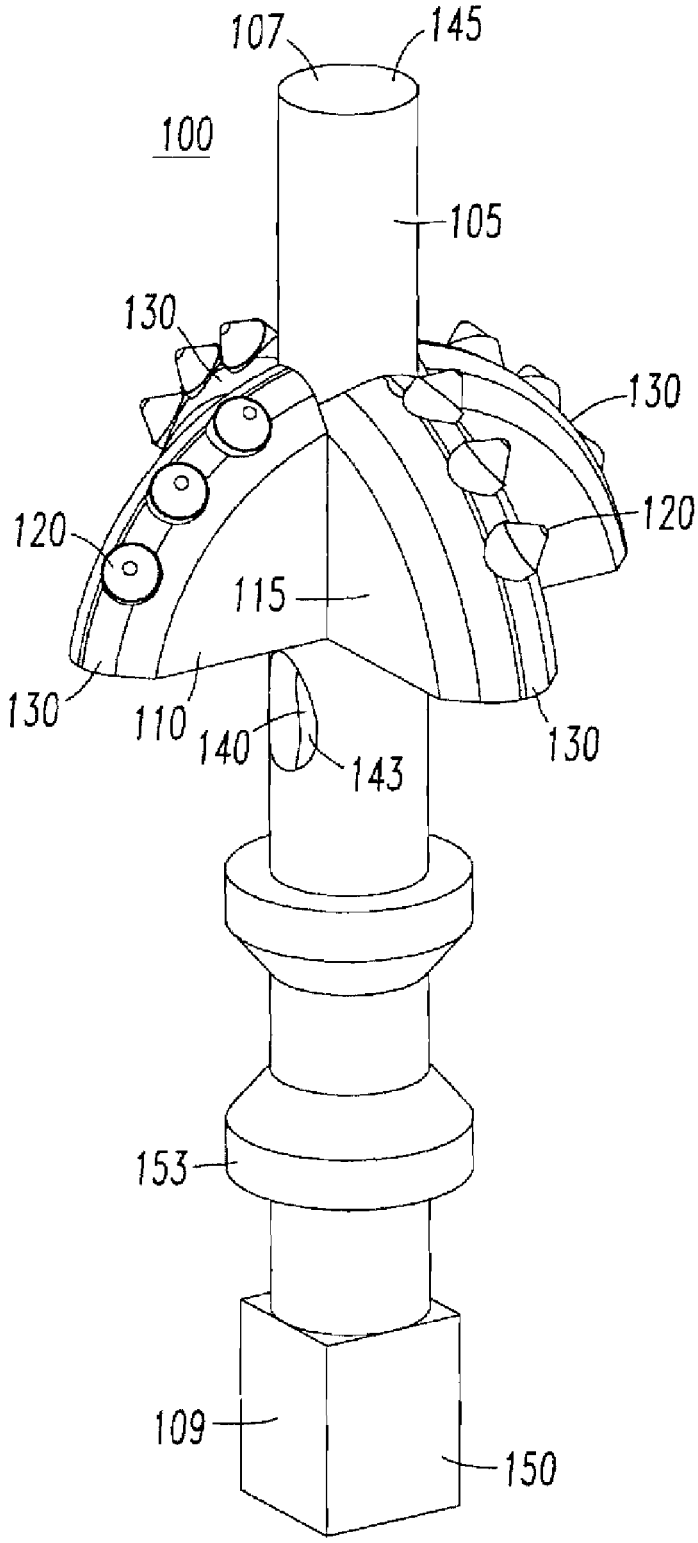
FIG. 4A is a perspective view of a roof bit drill in accordance with a first embodiment of the subject invention.
Figure 4B:
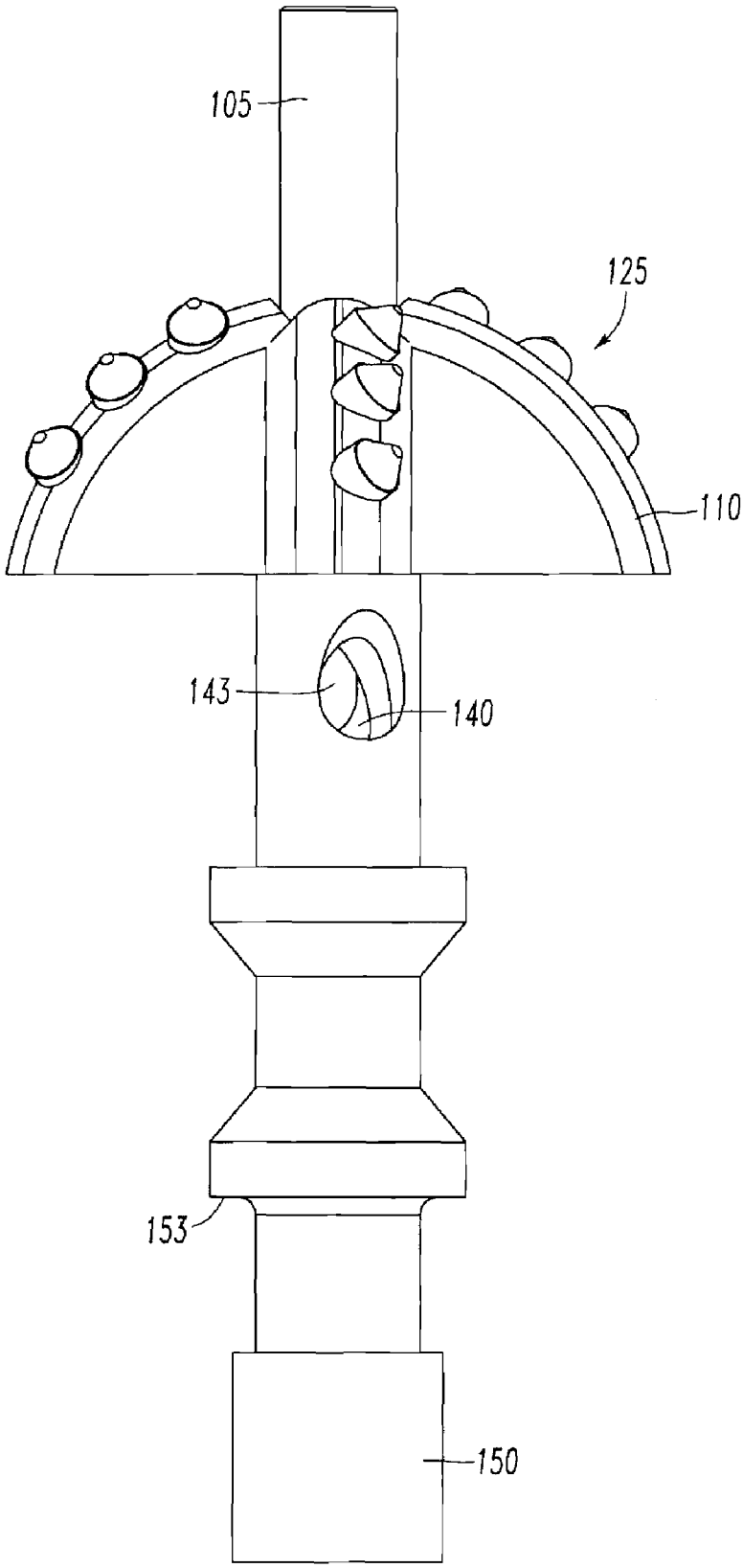
FIG. 4B is a side view of the roof bit drill illustrated in FIG. 4A.
Figure 4C:
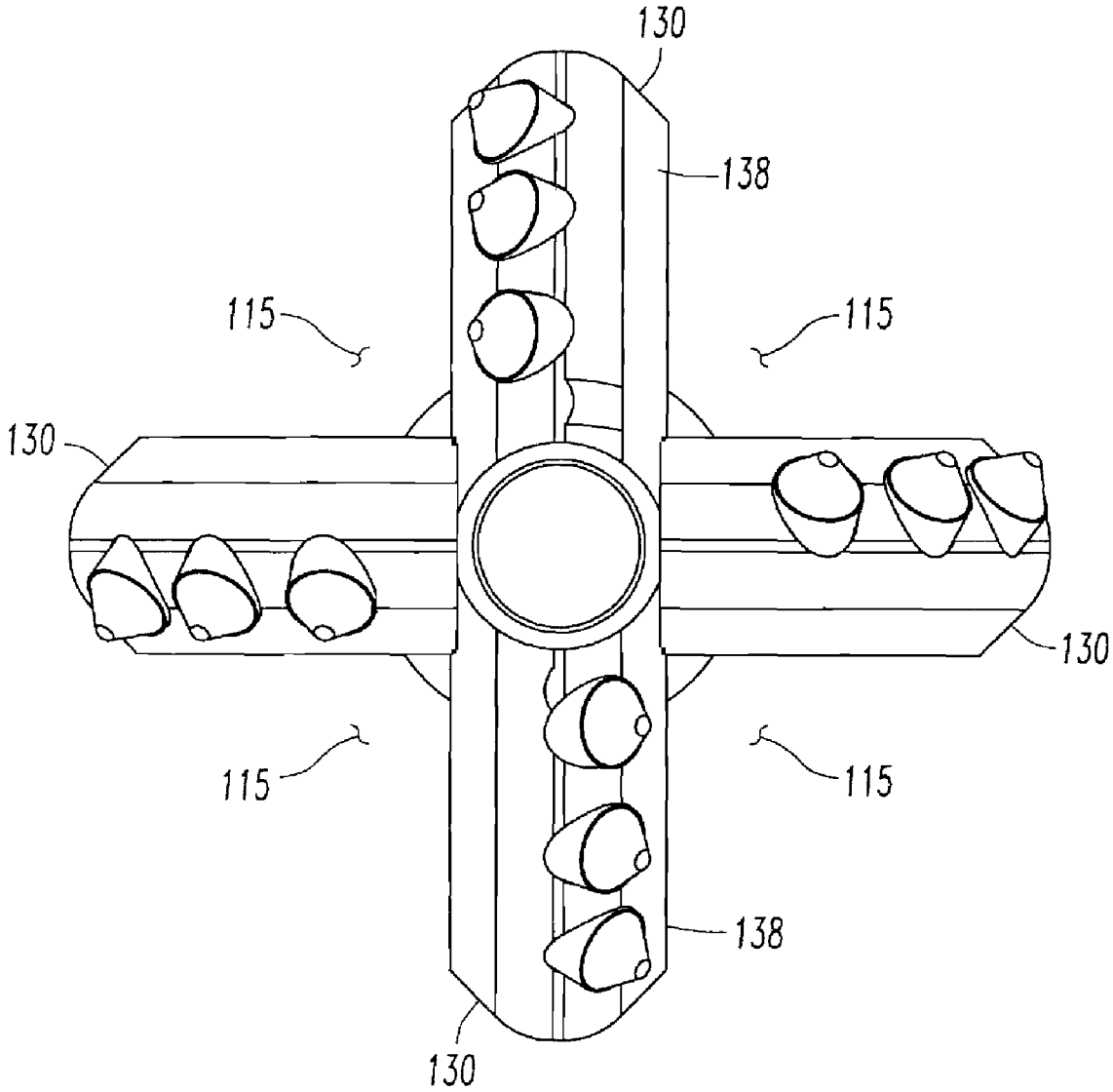
FIG. 4C is a top view of the roof bit drill illustrated in FIG. 4A.

FIGS. 4A, 4B and 4C illustrate a roof bit drill 100 in accordance with a first embodiment of the subject invention. In particular, the roof bit drill 100 is comprised of a central shaft 105 having a front end 107 and a back end 109. A base 110 is secured about the central shaft 105 proximate to the front end 107. The base 110 has clearance channels 115 extending axially through the base 110. The drill 100 further contains a plurality of cutting elements 120 arranged on the base 110 to define, as best illustrated in FIG. 4B, a convex cutting pattern 125.

As illustrated in FIGS. 4A and 4B, the cutting elements 120 are arranged so that the convex Cutting pattern 125 generally defines a dome-shape. As illustrated in FIG. 4A, the base 110 may be comprised of radially extending members 130 extending from the central shaft 105. As further illustrated, there is at least one cutting element 120 arranged on each of the radially extending members 130 and together these cutting elements 120 substantially outline the concave cutting pattern 125. In the present embodiment, the plurality of cutting elements 120 are each comprised of a plug bit which is secured within matching bores in the base 110.

The clearance channels 115 are important for proper operation of the roof drill bit to permit material removed from the roof by the drill to be evacuated. In particular, in the absence of such clearance channels, the drill would be capable of advancing only a very small amount before the newly loosened material, which is now entrapped by the roof bit drill, would act as a physical barrier to further advancement of the drill. Therefore, the clearance channels 115 permit the newly loosened material to be evacuated thereby allowing the cutting elements 120 to act on a new surface. As illustrated in the first embodiment, the radially extending members 130 are fins 138 extending from the central shaft 105. As illustrated, there are four fins 138 located symmetrically about the central shaft 105, thereby providing a dynamically balanced configuration. Consistent with providing such a dynamically balanced configuration, it is possible that there may a different number of fins 138 extending from the central shaft 105.

The roof bit drill 100 further includes a vacuum port 140 in the region of the cutting elements 120. The vacuum port 140 is in fluid communication with a vacuum passageway 143 which extends through the central shaft 105 to a vacuum source (not shown). Dust and small particles removed by the cutting elements 120 may be evacuated through the vacuum port 140 to minimize dispersion of dust and small particles within the environment of the roof bit drill 100. As illustrated in FIGS. 4A and 4B, the front end 107 of the shaft 105 is a pilot pin 145 used to locate the drill 100 within a pre-drilled hole in the roof of the mine.

At the back end 109 of the shaft 105 is a driven portion 150 adapted to be received by a machine driver (not shown) which imparts rotary motion to the roof bit drill. The central shaft 105 may have a lower shoulder 153 which axially locates the driven portion 150 within the machine driver.

Figure 5A:
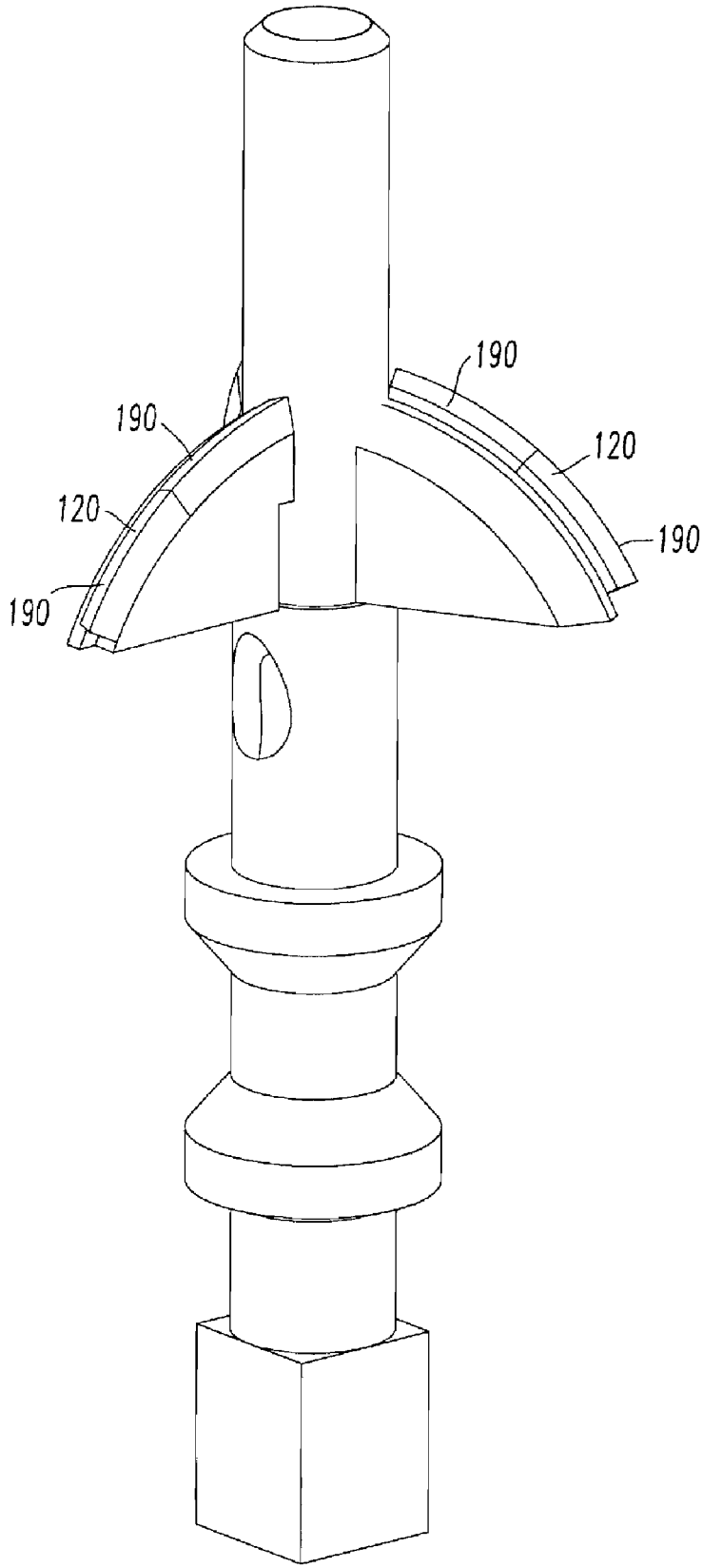
FIG. 5A is a perspective view of a roof bit drill in accordance with the second embodiment of the subject invention.
Figure 5C:
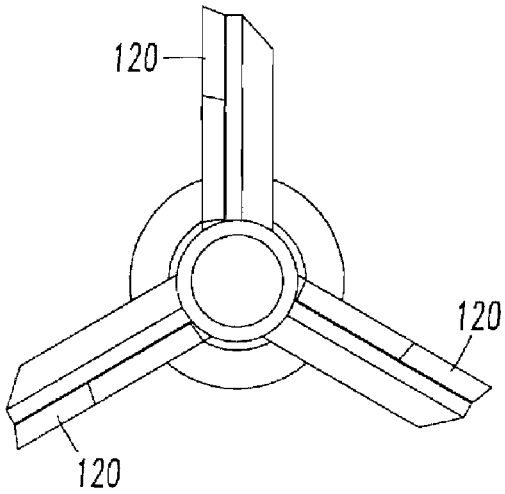
FIG. 5C is a top view of the roof bit drill illustrated in FIG. 5A.
Figure 5B:
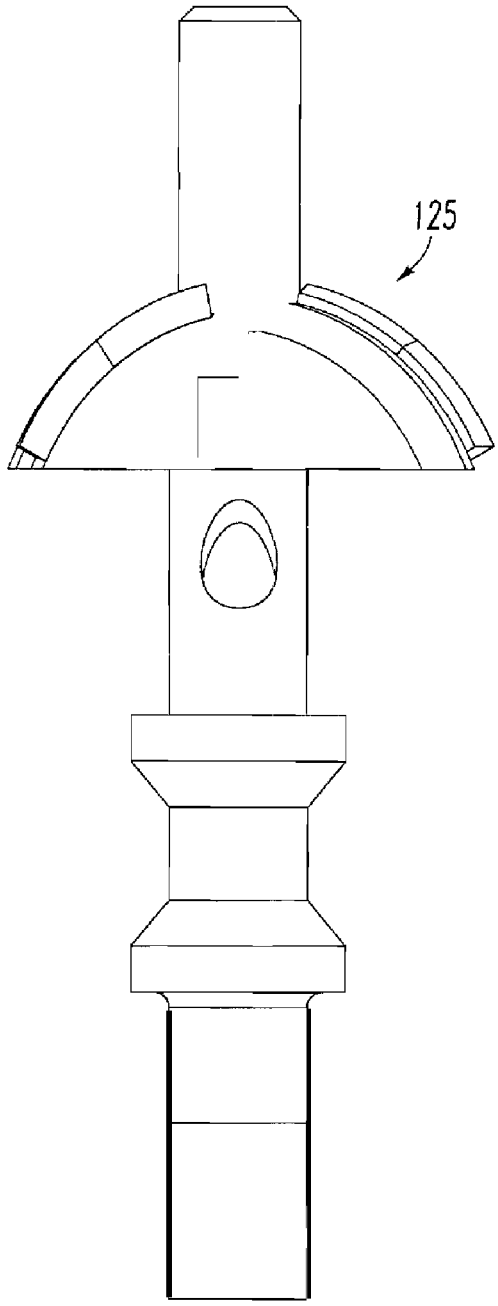
FIG. 5B is a side view of the roof bit drill illustrated in FIG. 5A.

The embodiment illustrated in FIGS. 4A-4C presented a plurality of cutting elements 120 mounted about radially extending members 130. In particular, these cutting elements 120 were plug bits 135. As illustrated in FIGS. 5A-5C, it is entirely possible for the cutting elements 120 to be comprised of cutting blades 190 which are arranged on each of the radially extending members 130 and which together substantially outline a concave cutting pattern 125. It should be appreciated that one or more cutting blades 190 may be associated with a particular radially extending member 130. While four radially extending blades 120 are shown on the drill 100 in FIGS. 4A-4C and three radially extending blades 120 are shown on the drill in FIGS. 5A-5C, it is possible for each of these drills to have a different number of radially extending blades 120. For example, the drill 100 in FIGS. 4A-4C, may have three radially extending blades 120 while the drill in FIGS. 5A-5C may have four radially extending blades 120.

Figure 6A:
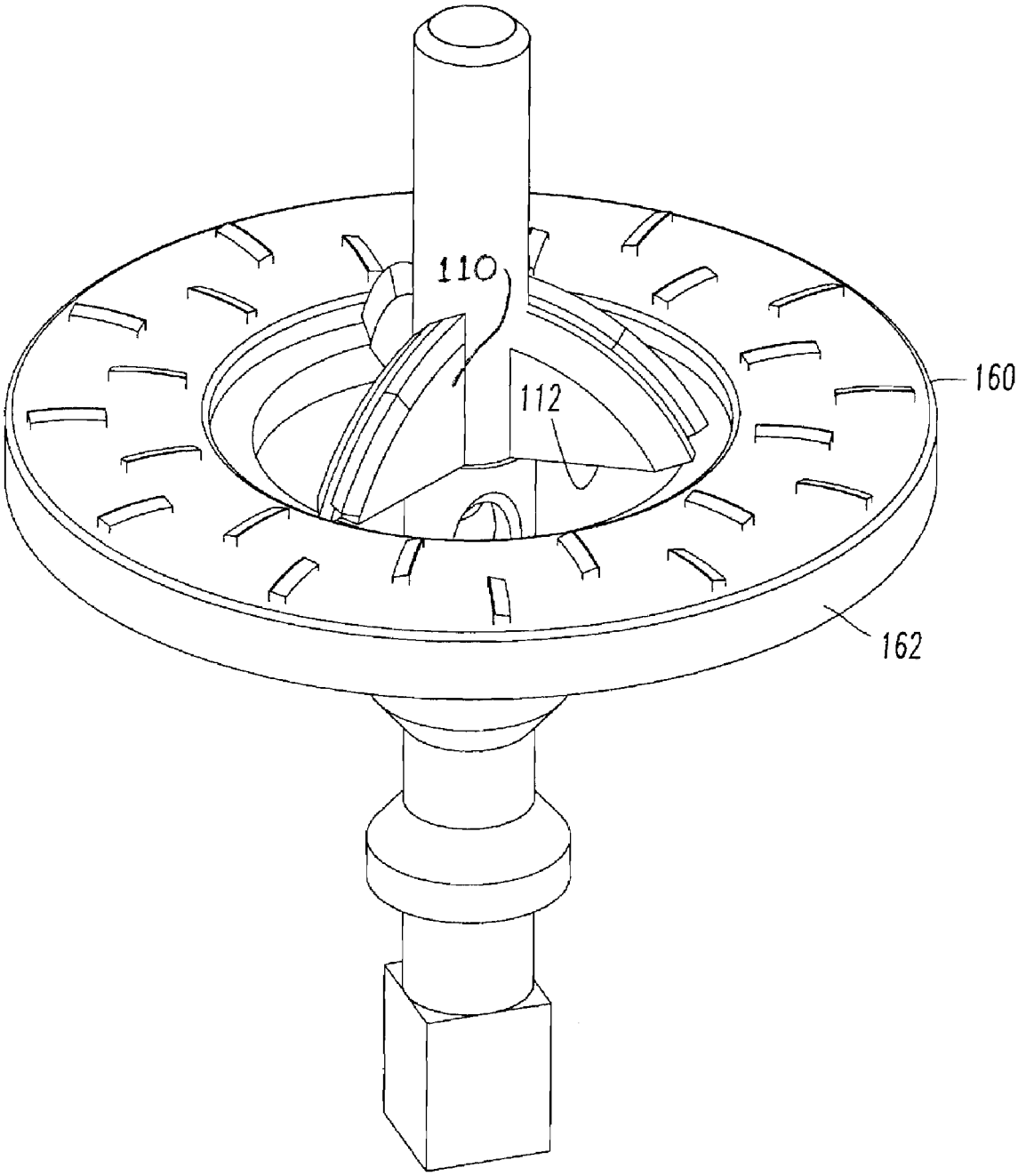
FIG. 6A is a perspective view of a roof bit drill in accordance with a third embodiment of the subject invention.
Figure 6B:
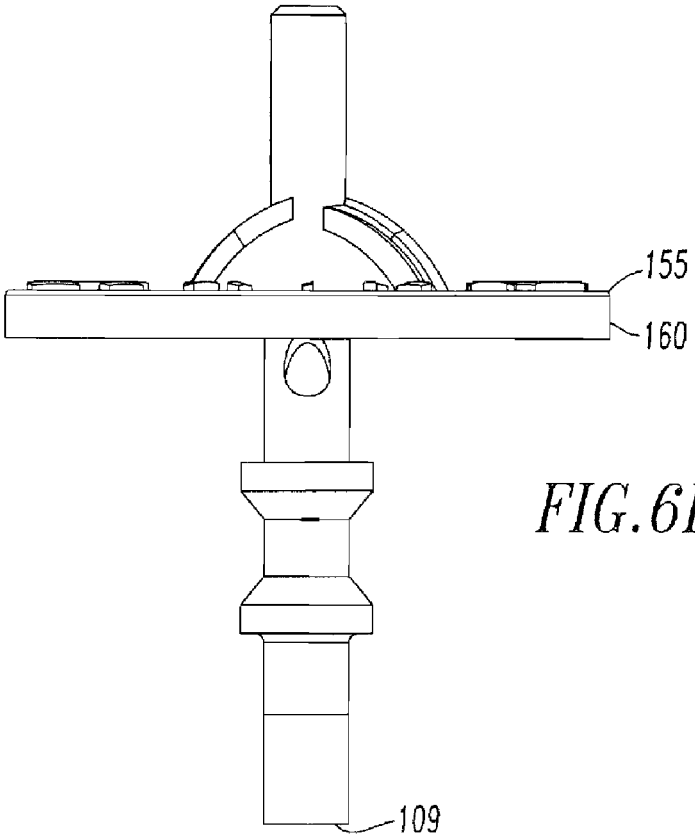
FIG. 6B is a side view of the roof bit drill illustrated in FIG. 6A.
Figure 6C:
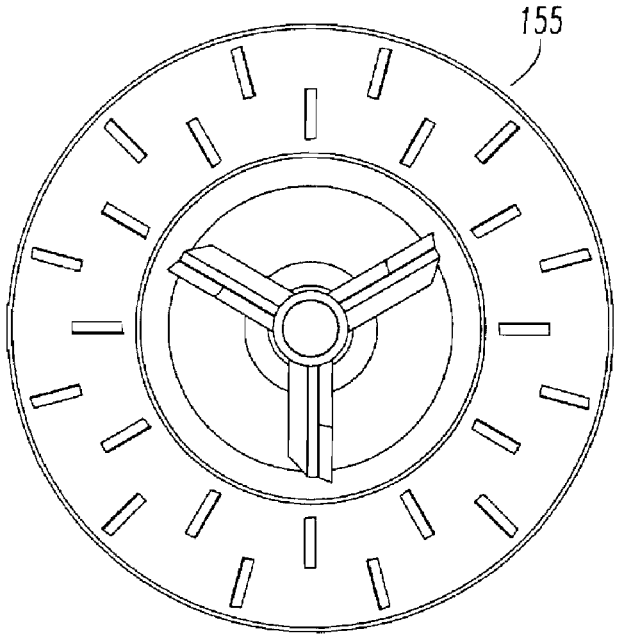
FIG. 6C is a top view of the roof bit drill illustrated in FIG. 6A.

Optimally, the crater plate 14 adapted to be secured within the countersunk portion of the roof should contact as much of the roof and countersunk portion as possible. Therefore, it is important to drill the counter bore with a certain level of precision so that when the concaved-shaped crater plate 14 is introduced within the counter bore, the top surface of the crater plate 14 will contact the exposed surface of the counter bore within the roof. In order to assist the operator to determine when advancement of the roof drill bit within the roof should cease, the subject invention further includes, as illustrated in FIGS. 6A-6C, a drill depth locator 155 with at least one protrusion 160 secured at the back surface 112 of the base 110. As illustrated in FIGS. 6A-6C, the protrusion 160 is a circular ring 162 secured to the base 110.

Figure 7A:
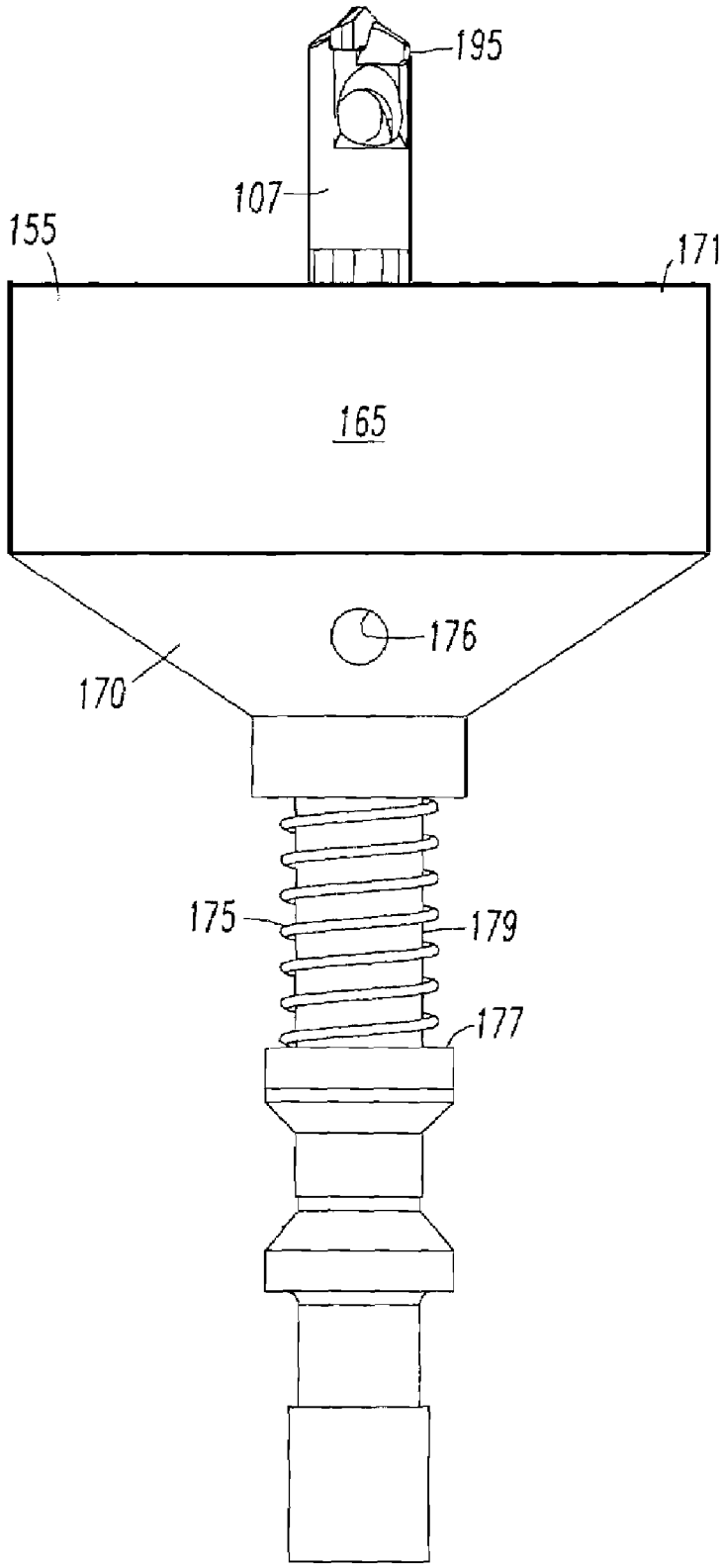
FIG. 7A is a side view of a roof bit drill in accordance with a fourth embodiment of the subject invention with a boot in the extended position.

In an alternative embodiment, as illustrated in FIGS. 7A-7C, the drill depth locator 155 is a resilient assembly 165 which signals the depth to which the assembly 165 compresses when the roof bit drill is advanced within a mine roof. In particular, the resilient assembly 165 is a boot 170 surrounding the central shaft 105 and the base 110. The boot 170 generally conforms to the shape of the base 110. The boot 170 is axially supported on the central shaft 105 by a spring 175 such that the boot 170 is resiliently displaced in the axial direction when the roof bit drill is advanced within the mine roof. The depth locator 155 signals the drill depth by either the sound the protrusion 160 makes upon contacting the mine roof or the visual appearance of the protrusion 160 as it contacts the roof mine.

In the embodiment illustrated in FIGS. 7A-7C and each of the other embodiments illustrated herein, the central shaft 105 has an upper shoulder 177 to support the boot 170. As further illustrated in FIGS. 7A-7C, the spring 175 is a coil spring 179 which rests upon the upper shoulder 177 and supports the boot 170.

Figure 8A:
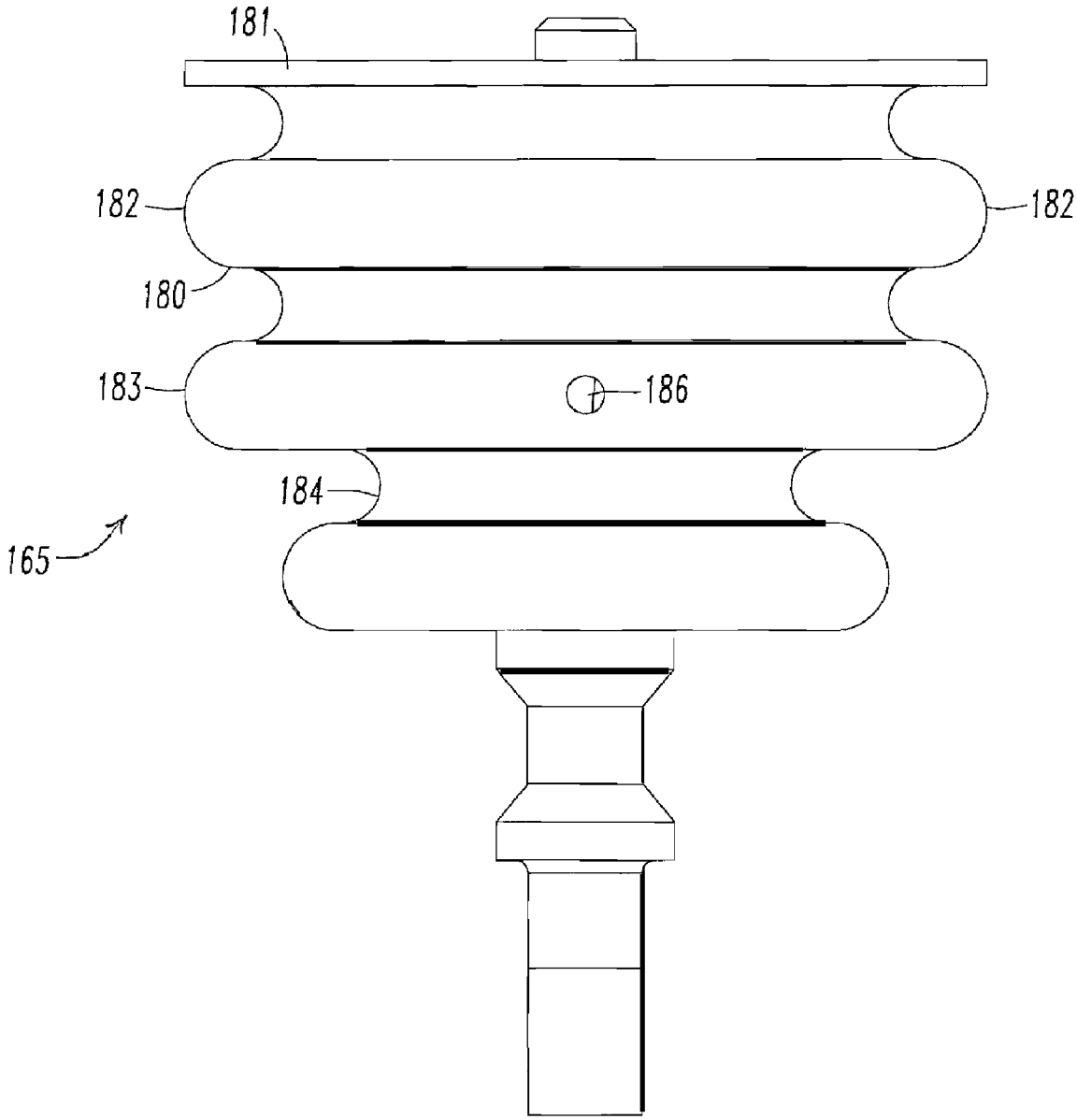
FIG. 8A is a side view of a roof bit drill in accordance with a fifth embodiment of the subject invention, wherein a boot is shown in an extended position.
Figure 8B:
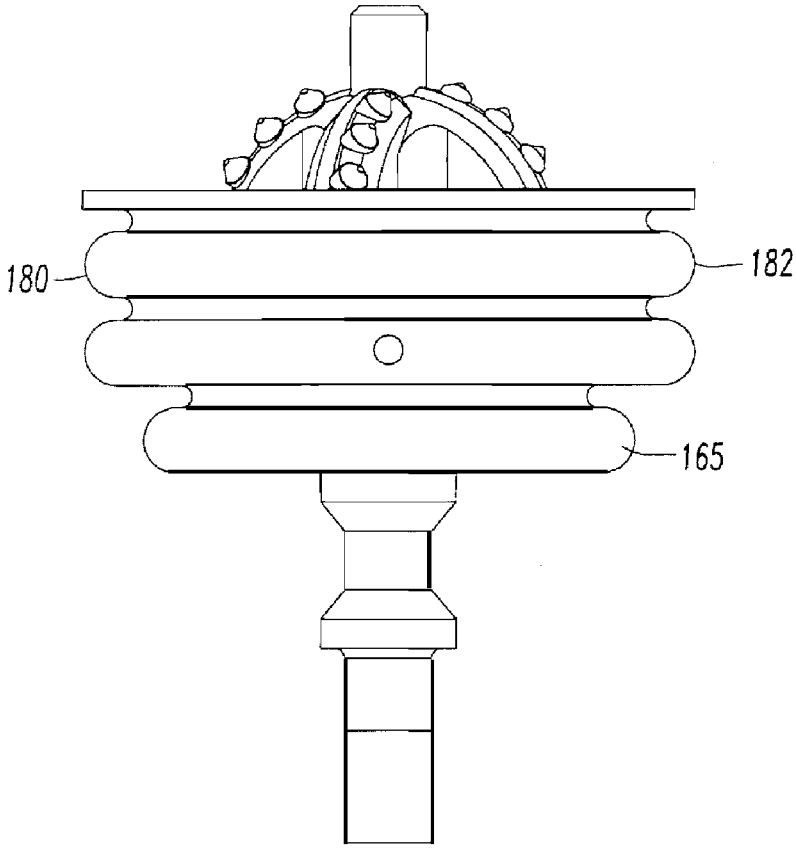
FIG. 8B is a side view of the roof bit drill illustrated in FIG. 8A with the boot in a retracted position.
Figure 8C:
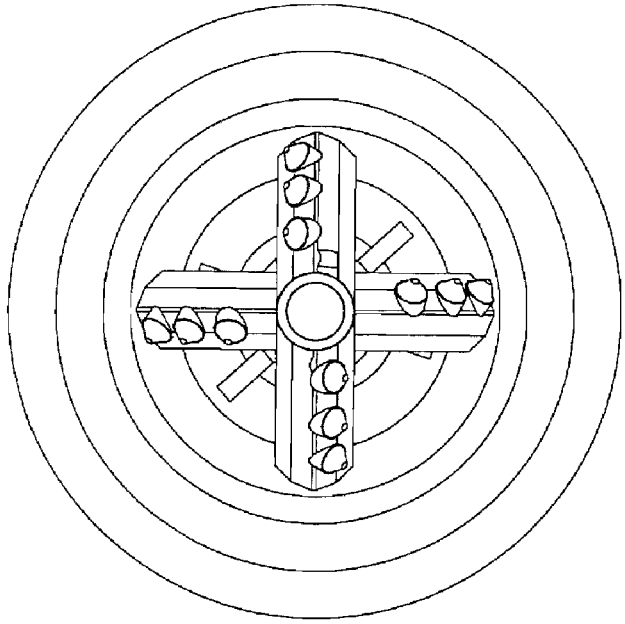
FIG. 8C is a top view of the roof bit drill illustrated in FIGS. 8A and 8B.

In the alternative, as illustrated in FIGS. 8A-8C, the resilient assembly 165 is a boot 180 having convoluted walls 182 which resiliently compress in the axially direction when the roof bit drill is advanced within the mine roof. The outermost segments 183 of the convoluted walls 182 may be a different color than the innermost segments 184, such that when the boot 180 is fully compressed in the axially direction, the compressed boot 180, as illustrated in FIG. 8B, appears to be a single color.

Briefly returning to FIGS. 4A and 4B, it should be appreciated that the vacuum port 140 is essentially directly beneath the base 110. The same relative position of the vacuum port 140 illustrated in FIGS. 4A-4C is also present in the embodiments illustrated in FIGS. 7A-7C and FIGS. 8A-8C. However, with attention directed to the FIGS. 7A-7C embodiment, the boot 170 conceals the vacuum port 140 while, with respect to the embodiment illustrated in FIGS. 8A-8C, the boot 180 conceals the vacuum port. Nevertheless, in each of the embodiments illustrated in FIGS. 7A-7C and FIGS. 8A-8C, there is a vacuum port 140 in the region of the cutting elements 120. The boot 170 may have a flat top 171 just as the boot 180 may have a flat top 181 adapted to seal against the roof of the mine to further ensure that dust and small particles loosened by the roof bit drill are effectively evacuated. The boot 170 may have an air hole 176 while the boot 180 may have an air hole 186 to prevent collapse when the boots 170, 180 are subjected to a vacuum and the flat top 171, 181 of either is sealed against the roof of the mine.

It should be noted that, as illustrated in FIGS. 7A, 7B and FIGS. 8A, 8B, the vacuum port 140 remains within the boot 170, 180 throughout the axial travel of the roof bit drill within the roof of a mine.

So far discussed and directing attention to the embodiment illustrated in FIGS. 4A-4C, the roof bit drill 100 has a pilot pin 145 at the front end 107 of the central shaft 105. Directing attention to FIGS. 7A-7B, it is entirely possible for the front end 107 of the central shaft 105 to have a pilot drill 195 comprised of a conventional pinning rod system drill bit for which a variety of different types are commercially available. It should be appreciated that the pilot drill 195 would also have associated with it a vacuum source extending through the central shaft 105 to remove dust and small material during the drilling of a pilot hole.

Figure 1:
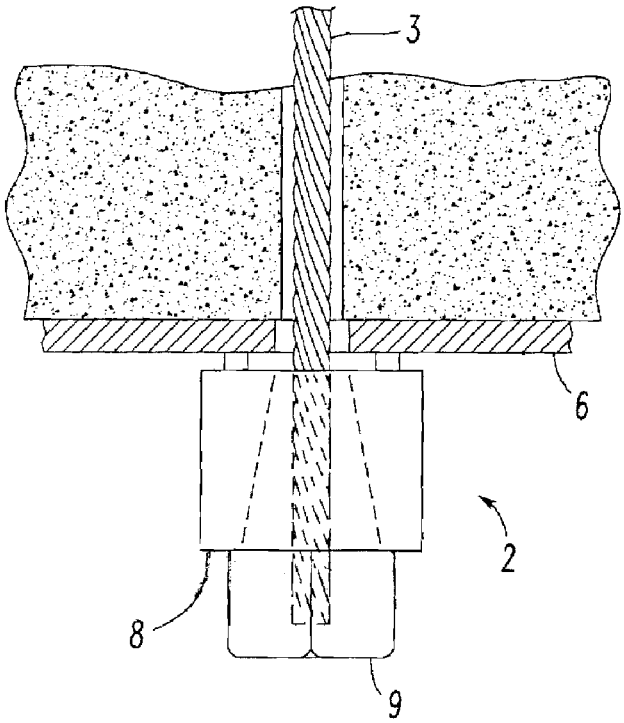
FIG. 1 PRIOR ART
FIG. 1 is a partial sectional view of a prior art mine roof support utilizing a cable bolt, wherein the cable bolt protrudes entirely below a roof line.
Figure 2:
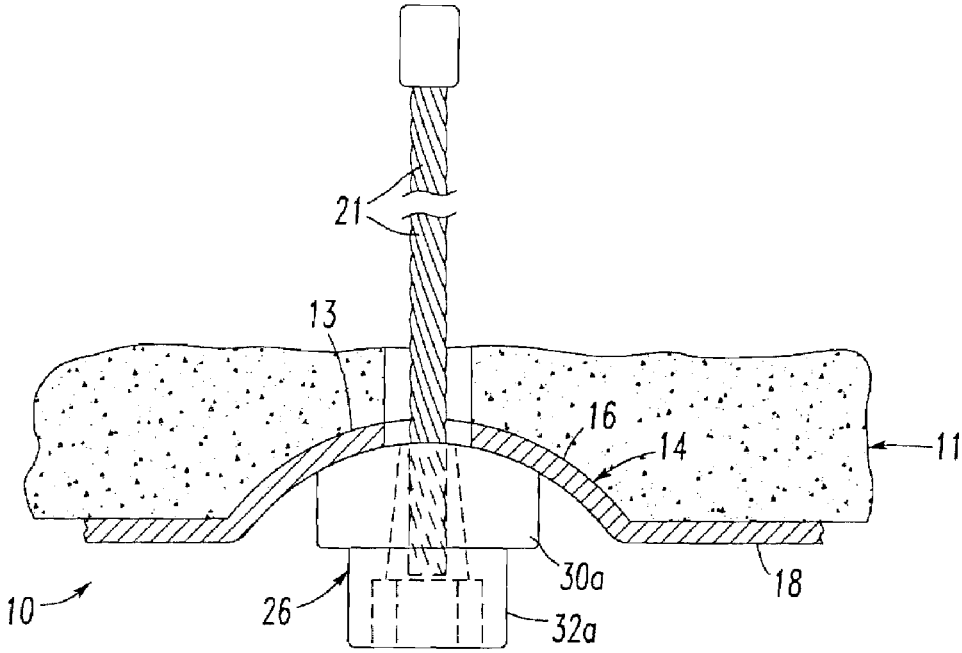
FIG. 2 PRIOR ART
FIG. 2 is a partial sectional view of a prior art mine roof support utilizing a cable bolt recessed within a countersink within the roof thereby minimizing the protrusion of the mine roof support.
Figure 3:
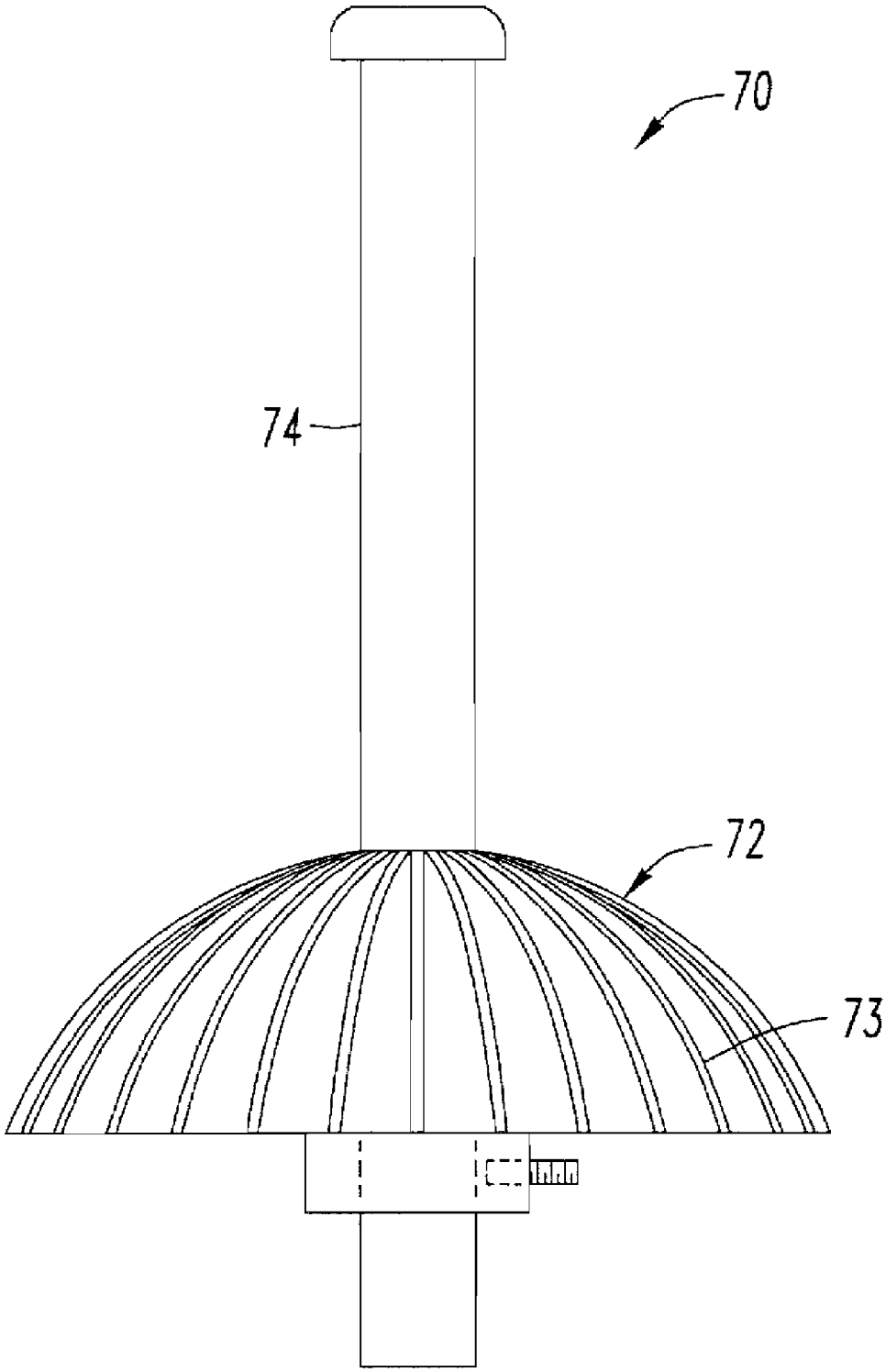
FIG. 3 PRIOR ART
FIG. 3 is an elevation view of a roof bit drill utilizing a convex base for imparting a dome-shaped counter bore within the roof.
Figure 9A:
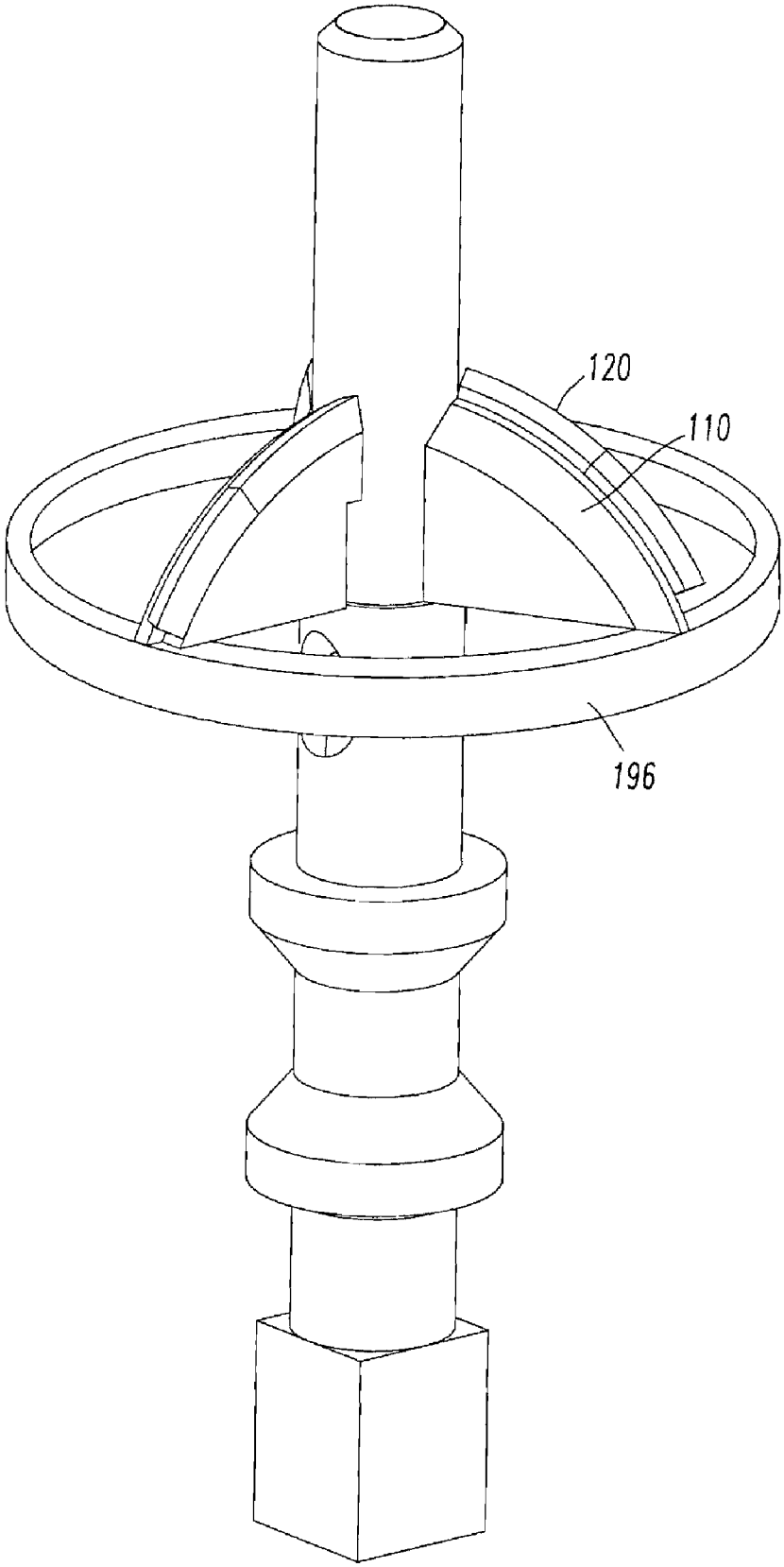
FIG. 9A is a perspective view of a roof bit drill in accordance with a sixth embodiment of the subject invention.
Figure 9B:
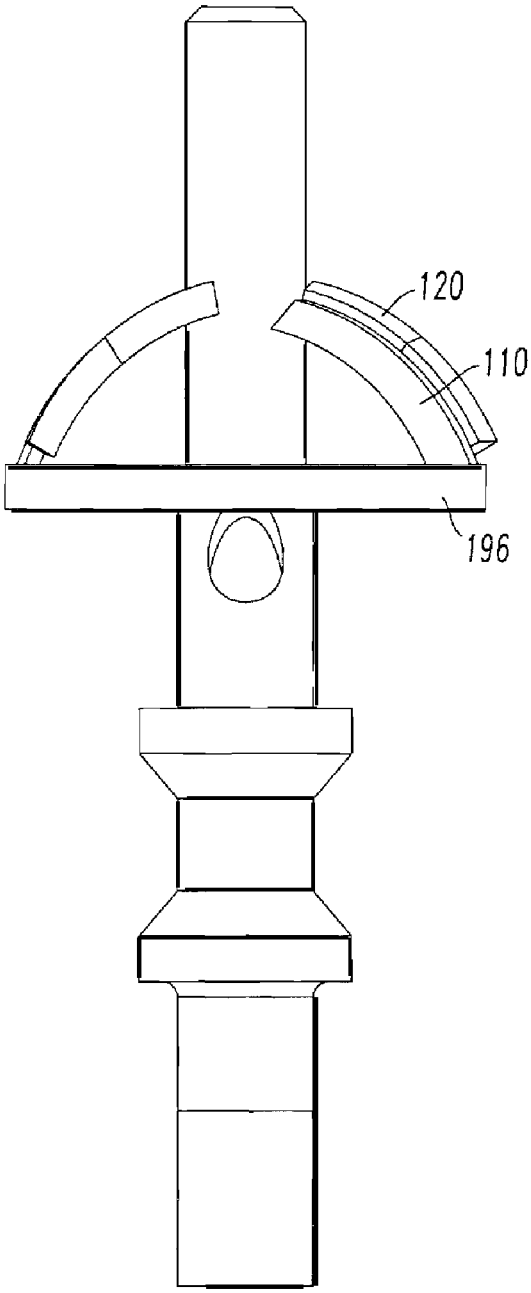
FIG. 9B is a side view of the roof bit drill illustrated in FIG. 9A.
Figure 9C:
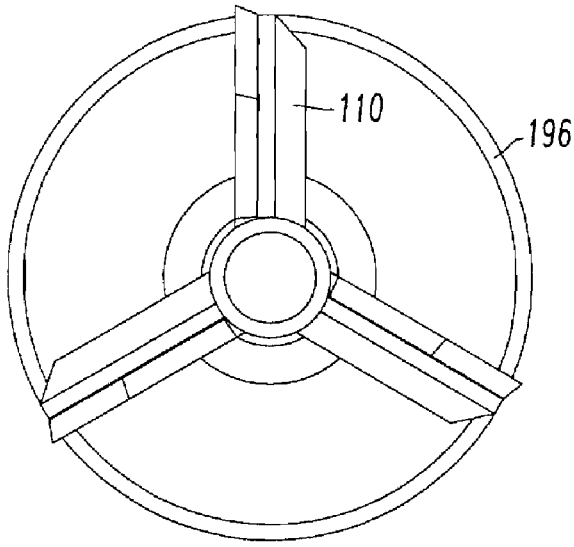
FIG. 9C is a top view of the roof bit drill illustrated in FIG. 9A.

In a final embodiment of the subject invention illustrated in FIGS. 9A-9C, the roof drill bit may further include a rim cutter 196 mounted below the base 110 and extending radially outwardly such that once the cutting element 120 mounted upon the base 110 produces the concave counter bore within the mine roof the roof bit drill may advance further and the rim cutter 196 will cut a ring within the mine roof beyond the perimeter of the cutting elements 120 mounted upon the base 110. It should be appreciated that by utilizing such a configuration, the roof bit drill may be advanced within the roof of the mine to any desired depth. The outer diameter of the rim 196 is greater than the outer diameter of the rim portion 18 (FIG. 2) of the bearing 18. As a result, it is entirely possible to completely recess the crater plate 14 with the cable bolt 21 or rod bolt fully within the roof line.

The subject invention is also directed to a method for identifying a predetermined depth for the advancement of a roof bit bolt 100 comprising the steps of advancing the roof bit bolt 100 within the roof of a mine until a depth indicator 155 (FIG. 7B) signals the proper depth has been reached. In particular, when the roof bit bolt is surrounded by a resilient boot 170 and the roof bit bolt is advanced. At the time the resilient boot 180 is compresses a predetermined amount, advancement of the roof bit drill is stopped.

In one embodiment, the boot 170 is supported on the central shaft 105 by a spring 175 and the roof bit bolt is advanced until the spring 175 deflects a predetermined amount, which may be determined visually by the operator of the machine, at which time the roof bit drill advancement is stopped.

In accordance with another embodiment, the boot 180 has resilient convoluted walls 182 and the roof bit bolt is advanced until the outer most segments 183 of the convoluted walls 182 are compressed to the point of contacting one another, at which time the roof bit drill advancement is stopped.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A roof bit drill comprised of:

a) a central shaft with a front end and a back end, b) a base secured about the central shaft proximate to the front end, wherein the base has clearance channels extending axially therethrough; and c) at least one cutting element arranged on the base in a convex cutting pattern, wherein the front end of the central shaft extends beyond the at least one cutting element.

2. The roof bit drill according to claim 1, wherein the at least one cutting element is arranged to generally define a dome shape.

3. The roof bit drill according to claim 1, wherein the base is comprised of radially extending members extending from the central shaft.

4. The roof bit drill according to claim 3, wherein there is at least one cutting element arranged on each of the radially extending members which together substantially outline a cutting pattern.

5. The roof bit drill according to claim 4, wherein there are a plurality of cutting elements and each cutting element is a plug bit.

6. The roof bit drill according to claim 4, wherein the at least one cutting element is a cutting blade.

7. The roof bit drill according to claim 3, wherein the radially extending members are fins extending from the central shaft.

8. The roof bit drill according to claim 7, wherein there are at least two fins extending from the central shaft.

9. The roof bit drill according to claim 8, wherein the fins are symmetric about the central shaft.

10. The roof bit drill according to claim 1, further including a vacuum port in the region of the at least one cutting element, wherein the port is in fluid communication with a vacuum passageway extending through the central shaft.

11. The roof bit drill according to claim 1, wherein the front end of the shaft is a pilot pin used to locate the drill.

12. The roof bit drill according to claim 1, wherein the front end of the shaft is a pilot drill.

13. The roof bit drill according to claim 12, wherein the pilot drill is a spade drill.

14. The roof bit drill according to claim 1, further including a drill depth locator to identify when the drill has been advanced within a mine roof to a predetermined depth.

15. The roof bit drill according to claim 14, wherein the drill depth locator is at least one protrusion secured at the back surface of the base.

16. The roof bit drill according to claim 15, wherein the at least one protrusion is a circular ring secured at the base.

17. The roof bit drill according to claim 14, wherein the drill depth locator is a resilient assembly which signals depth by the degree to which the assembly compresses when the drill is advanced within a mine roof.

18. The roof bit drill according to claim 17, wherein the resilient assembly is a boot surrounding the central shaft and the base.

19. The roof bit drill according to claim 18, wherein the boot is generally conforms to the shape of the base.

20. The roof bit drill according to claim 18, wherein the boot is axially supported on the central shaft by a spring such that the boot is resiliently displaced in the axial direction when the drill is advanced within the mine roof.

21. The roof bit drill according to claim 20, wherein the spring is a coil spring.

22. The roof bit drill according to claim 18, wherein the resilient assembly is a boot having convoluted walls which resiliently compress in the axial direction when the drill is advanced within the mine roof.

23. The roof bit drill according to claim 22, wherein the outermost segments of the convoluted walls are a different color than the innermost segments such that when the boot is fully compressed in the axial direction, the compressed boot appears to be a single color.

24. The roof bit drill according to claim 18, further including a vacuum port in the region of the at least one cutting element, wherein the port is in fluid communication with a vacuum passageway extending through the central shaft and wherein the boot has a flat top adapted to seal against the roof of a mine and the boot furthermore has an air hole to prevent collapse under vacuum.

25. The roof bit drill according to claim 24, wherein the vacuum port remains within the boot throughout the axial travel of the drill within the roof of a mine.

26. The roof bit drill according to claim 18, wherein the central shaft has an upper shoulder to support the boot.

27. The roof bit drill according to claim 18, wherein the back end of the shaft has a driven portion adapted to be received by a machine driver and wherein the central shaft has a lower shoulder to axially locate the driven portion within the machine driver.

28. The roof bit drill according to claim 1, further including a rim cutter mounted below the base and extending radially outwardly to cut a ring within the mine roof beyond the perimeter of the at least one cutting element mounted upon the base.

29. A roof bit drill comprised of:

a) a central shaft with a front end and a back end, b) a base secured about the central shaft proximate to the front end, wherein the base has clearance channels extending radially therethrough;

c) at least one cutting element arranged on the base; and d) a drill depth locator to identify when the drill has been advanced within a mine roof to a predetermined depth.

30. The roof bit drill according to claim 29, wherein the drill depth locator is at least one protrusion secured at the base facing the back end of the central shaft.

31. The roof bit drill according to claim 30, wherein the at least one protrusion is a circular ring secured at the base.

32. The roof bit drill according to claim 29, wherein the drill depth locator is a resilient assembly which signals depth by the degree to which the assembly compresses when the drill is advanced within a mine roof.

33. The roof bit drill according to claim 32, wherein the resilient assembly is a boot surrounding the central shaft and the base.

34. The roof bit drill according to claim 33, wherein the boot generally conforms to the shape of the base.

35. The roof bit drill according to claim 33, wherein the boot is axially supported on the central shaft by a spring, such that the boot is resiliently displaced in the axial direction when the drill is advanced within the mine roof.

36. The roof bit drill according to claim 35, wherein the spring is a coil spring.

37. The roof bit drill according to claim 33, wherein the resilient assembly is a boot having convoluted walls which resiliently compress in the axial direction when the drill is advanced within the mine roof.

38. The roof bit drill according to claim 37, wherein the outermost segments of the convoluted walls are a different color than the innermost segments such that when the boot is fully compressed in the axial direction, the compressed boot appears to be a single color.

39. The roof bit drill according to claim 33, further including a vacuum port in the region of the at least one cutting element, wherein the port is in fluid communication with a vacuum passageway extending through the central shaft and wherein the boot has a flat top adapted to seal against the roof of a mine and the boot furthermore has an air hole to prevent collapse under vacuum.

40. The roof bit drill according to claim 39, wherein the vacuum port remains within the boot throughout the axial travel of the drill within the roof of a mine.

41. The roof bit drill according to claim 33, wherein the central shaft has an upper shoulder to support the boot.

42. The roof bit drill according to claim 33, wherein the rear end of the shaft has a driven portion adapted to be received by a machine driver and wherein the central shaft has a lower shoulder to locate the driven portion within the machine driver.

43. A method of identifying a predetermined depth for the advancement of a roof bit bolt comprising the steps of:

providing a roof bit bolt comprising:

a central shaft with a front end and a back end, a base secured about the central shaft proximate to the front end, wherein the base has clearance channels extending axially therethrough; and at least one cutting element arranged on the base in a convex cutting pattern, advancing the roof bit bolt within the roof of a mine until a depth indicator signals the proper depth has been reached.

44. The method according to claim 43, wherein the roof bit bolt is surrounded by a resilient boot and the roof bit bolt is advanced until the resilient boot is compressed a predetermined amount, at which time the roof bit drill advancement is stopped.

45. The method according to claim 44, wherein the boot is supported on a central shaft by a spring and the roof bit drill is advanced until the spring deflects a predetermined amount, at which time the roof bit drill advancement is stopped.

46. The method according to claim 44, wherein the boot has resilient convoluted walls and the roof bit bolt is advanced until adjacent individual convolutions are compressed to the point of contacting one another.

* * * * *

UNITED STATES PATENT AND TRADEMARK OFFICE

CERTIFICATE OF CORRECTION

PATENT NO. : 7,708,087 B2
APPLICATION NO. : 11/733372
DATED : May 4, 2010
INVENTOR(S) : Stables et al.

It is certified that error appears in the above-identified patent and that said Letters Patent is hereby corrected as shown below:

Column 5, Line 58, "is compresses" should read -- is compressed --

Column 7, Line 5, of Claim 19, "is generally conforms" should read -- generally conforms --

Signed and Sealed this

Twenty-first Day of September, 2010

David J. Kappos

David J. Kappos
*Director of the United States Patent and Trademark Office*